US007214293B2

(12) United States Patent
Trokhan et al.

(10) Patent No.: US 7,214,293 B2
(45) **Date of Patent: *May 8, 2007**

(54) PROCESS FOR MAKING A UNITARY FIBROUS STRUCTURE COMPRISING CELLULOSIC AND SYNTHETIC FIBERS

(75) Inventors: Paul Dennis Trokhan, Hamilton, OH (US); Dean Van Phan, West Chester, OH (US); Osman Polat, Montgomery, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/398,844

(22) Filed: Apr. 6, 2006

(65) Prior Publication Data

US 2006/0175030 A1 Aug. 10, 2006

Related U.S. Application Data

(62) Division of application No. 10/360,038, filed on Feb. 6, 2003, now Pat. No. 7,052,580.

(51) Int. Cl.
*D21H 13/10* (2006.01)
*D21H 27/02* (2006.01)
*B31F 1/00* (2006.01)

(52) U.S. Cl. ..... 162/146; 162/109; 162/117; 162/157.2; 162/157.3; 264/113

(58) Field of Classification Search ..... 162/141, 162/146, 157.1–157.7, 109, 117, 123; 428/195, 428/156, 153–154; 156/62.2; 264/113
See application file for complete search history.

(56) References Cited

U.S. PATENT DOCUMENTS

| | | | |
|---|---|---|---|
| 3,116,199 | A | 12/1963 | Mamerto et al. |
| 3,558,429 | A | 1/1971 | Spence |
| 3,879,257 | A | 4/1975 | Gentile et al. |
| 3,947,315 | A | 3/1976 | Smith |
| 3,994,771 | A | 11/1976 | Morgan et al. |
| 4,012,281 | A | 3/1977 | Mayer et al. |
| 4,202,959 | A | 5/1980 | Henbest et al. |
| 4,300,981 | A | 11/1981 | Carstens |
| 4,440,597 | A | 4/1984 | Wells et al. |
| 4,486,268 | A | 12/1984 | Nuttall et al. |
| 4,487,796 | A | 12/1984 | Lloyd et al. |
| 4,529,480 | A | 7/1985 | Trokhan |
| 4,741,941 | A | 5/1988 | Englebert et al. |
| 4,808,467 | A | 2/1989 | Suskind et al. |
| 4,919,756 | A | 4/1990 | Sawdai |
| 5,094,717 | A | 3/1992 | Manning et al. |
| 5,098,522 | A | 3/1992 | Smurkoski et al. |
| 5,167,764 | A | 12/1992 | Nielsen et al. |
| 5,167,765 | A | 12/1992 | Nielsen et al. |
| 5,178,729 | A | 1/1993 | Janda |
| 5,180,620 | A | 1/1993 | Mende |
| 5,204,173 | A | 4/1993 | Canary |
| 5,245,025 | A | 9/1993 | Trokhan et al. |
| 5,260,171 | A | 11/1993 | Smurkoski et al. |
| 5,277,761 | A | 1/1994 | Van Phan et al. |
| 5,284,703 | A | 2/1994 | Everhart et al. |
| 5,334,289 | A | 8/1994 | Trokhan et al. |
| 5,364,504 | A | 11/1994 | Smurkoski et al. |
| 5,389,202 | A | 2/1995 | Everhart et al. |
| 5,405,499 | A | 4/1995 | Vinson |
| 5,425,987 | A | 6/1995 | Shawver et al. |
| 5,429,686 | A | 7/1995 | Chiu et al. |
| 5,443,691 | A | 8/1995 | Phan et al. |
| 5,496,624 | A | 3/1996 | Stelljes, Jr. et al. |
| 5,500,277 | A | 3/1996 | Trokhan et al. |
| 5,503,715 | A | 4/1996 | Trokhan et al. |
| 5,514,523 | A | 5/1996 | Trokhan et al. |
| 5,516,580 | A | 5/1996 | Frenette et al. |
| 5,529,664 | A | 6/1996 | Trokhan et al. |
| 5,538,595 | A | 7/1996 | Trokhan et al. |
| 5,549,790 | A | 8/1996 | Van Phan |

(Continued)

FOREIGN PATENT DOCUMENTS

| | | |
|---|---|---|
| EP | 0080382 B1 | 8/1988 |

(Continued)

OTHER PUBLICATIONS

U.S. Appl. No. 11/400,962, filed Apr. 10, 2006, Paul Dennis Trokhan, et al.

*Primary Examiner*—José A. Fortuna
(74) *Attorney, Agent, or Firm*—C. Brant Cook; Betty J. Zea; David M. Weirich

(57) ABSTRACT

A unitary fibrous structure comprises a plurality of cellulosic fibers randomly distributed throughout the fibrous structure, and a plurality of synthetic fibers distributed throughout the fibrous structure in a non-random repeating pattern. A process for making the unitary fibrous structure comprises the steps of providing an embryonic fibrous web comprising a plurality of cellulosic fibers randomly distributed throughout the fibrous web and a plurality of synthetic fibers randomly distributed throughout the fibrous web and causing redistribution of at least a portion of the synthetic fibers in the embryonic web to form the unitary fibrous structure in which a substantial portion of the plurality of synthetic fibers is distributed throughout the fibrous structure in a non-random repeating pattern.

10 Claims, 5 Drawing Sheets

U.S. PATENT DOCUMENTS 5,554,467 A 9/1996 Trokhan et al.
5,556,509 A 9/1996 Trokhan et al.
5,566,724 A 10/1996 Trokhan et al.
5,569,358 A 10/1996 Cameron
5,609,725 A 3/1997 Van Phan
5,614,061 A 3/1997 Van Phan et al.
5,624,790 A 4/1997 Trokhan et al.
5,629,052 A 5/1997 Trokhan et al.
5,637,194 A 6/1997 Ampulski et al.
5,672,248 A 9/1997 Wendt et al.
5,674,663 A 10/1997 McFarland et al.
5,693,187 A 12/1997 Ampulski et al.
5,718,806 A 2/1998 Trokhan et al.
5,741,402 A 4/1998 Trokhan et al.
5,744,007 A 4/1998 Trokhan et al.
5,746,887 A 5/1998 Wendt et al.
5,776,307 A 7/1998 Ampulski et al.
5,776,311 A 7/1998 Trokhan et al.
5,795,440 A 8/1998 Ampulski et al.
5,814,190 A 9/1998 Van Phan
5,817,377 A 10/1998 Trokhan et al.
5,830,321 A 11/1998 Lindsay et al.
5,846,379 A 12/1998 Ampulski et al.
5,855,739 A 1/1999 Ampulski et al.
5,861,082 A 1/1999 Ampulski et al.
5,885,421 A 3/1999 Ensign et al.
5,893,965 A 4/1999 Trokhan et al.
5,972,813 A 10/1999 Polat et al.
6,017,417 A 1/2000 Wendt et al.
6,171,442 B1 1/2001 Farrington, Jr. et al.
6,361,654 B1 3/2002 Chuang et al.
6,576,090 B1 6/2003 Trokhan et al.
7,041,196 B2 * 5/2006 Lorenz et al. ..... 162/146
7,045,026 B2 * 5/2006 Lorenz et al. ..... 156/62.2
7,052,580 B2 * 5/2006 Trokhan et al. ..... 162/109
7,067,038 B2 * 6/2006 Trokhan et al. ..... 162/109
2004/0154767 A1 8/2004 Trokhan et al.
2004/0154768 A1 * 8/2004 Trokhan et al. ..... 162/146
2004/0154769 A1 8/2004 Lorenz et al.
2006/0175030 A1 * 8/2006 Trokhan et al. ..... 162/146
2006/0180287 A1 * 8/2006 Trokhan et al. ..... 162/146

FOREIGN PATENT DOCUMENTS

EP 1236827 A1 9/2002
WO WO 93/14267 A1 7/1993
WO WO 00/20675 A1 4/2000
WO WO 00/39394 A1 7/2000

* cited by examiner

PROCESS FOR MAKING A UNITARY FIBROUS STRUCTURE COMPRISING CELLULOSIC AND SYNTHETIC FIBERS

CROSS REFERENCE TO RELATED APPLICATION

This application is a divisional application of U.S. application Ser. No. 10/360,038 filed Feb. 6, 2003, now U.S. Pat. No. 7,052,580.

FIELD OF THE INVENTION

The present invention relates to fibrous structures comprising cellulosic fibers and synthetic fibers in combination, and more specifically, fibrous structures having differential micro-regions.

BACKGROUND OF THE INVENTION

Cellulosic fibrous structures, such as paper webs, are well known in the art. Low-density fibrous webs are in common use today for paper towels, toilet tissue, facial tissue, napkins, wet wipes, and the like. The large consumption of such paper products has created a demand for improved versions of the products and the methods of their manufacture. In order to meet such demands, papermaking manufacturers must balance the costs of machinery and resources with the total cost of delivering the products to the consumer.

Various natural fibers, including cellulosic fibers, as well as a variety of synthetic fibers, have been employed in papermaking. Typical tissue paper is comprised predominantly of cellulosic fibers. The overwhelming majority of the cellulosic fibers used in tissue are derived from trees. Many species are used, including long fiber containing softwoods (conifer or gymnosperms) and short fiber containing hardwoods (deciduous or angiosperms). In addition, many different pulping approaches may be used. On one hand, there are Kraft and sulfite pulping processes followed by intense bleaching that produce flexible, lignin-free and very white fibers. On the other hand, there are thermo-mechanical or chemi-mechanical pulping processes that produce higher lignin containing fibers that are less flexible, prone to yellowing in sunlight and poorly wettable. As a general rule, the more lignin the fibers contain the less expensive they are.

Despite the broad range of fibers used in papermaking, cellulose fibers derived from trees are limiting when used exclusively in disposable tissue and towel products. Wood fibers are generally high in dry modulus and relatively large in diameter, which causes their flexural rigidity to be high. Such high-rigidity fibers tend to produce stiff non-soft tissue. In addition, wood fibers have the undesirable characteristic of having high stiffness when dry, which typically causes poor softness of the resulting product, and low stiffness when wet due to hydration, which typically causes poor absorbency of the resulting product. Wood-based fibers are also limiting because the geometry or morphology of the fibers cannot be "engineered" to any great extent. Except for relatively minor species variation, papermakers must accept what nature provides.

To form a useable web, the fibers in typical disposable tissue and towel products are bonded to one another through chemical interaction. If wet strength is not required, the bonding is commonly limited to the naturally occurring hydrogen bonding between hydroxyl groups on the cellulose molecules. If temporary or permanent wet strength is required in the final product, strengthening resins can be added. These resins work by either covalently reacting with the cellulose or by forming protective molecular films around the existing hydrogen bonds. In any event, all of these bonding mechanisms are limiting. They tend to produce rigid and inelastic bonds, which detrimentally affect softness and energy absorption properties of the products.

The use of synthetic fibers that have the capability to thermally fuse to one another and/or to cellulose fibers is an excellent way to overcome the previously mentioned limitations. Wood-based cellulose fibers are not thermoplastic and hence cannot thermally bond to other fibers. Synthetic thermoplastic polymers can be spun to very small fiber diameters and are generally lower in modulus than cellulose. This results in the fibers' very low flexural rigidity, which facilitates good product softness. In addition, functional cross-sections of the synthetic fibers can be micro-engineered during the spinning process. Synthetic fibers also have the desirable characteristic of water-stable modulus. Unlike cellulose fibers, properly designed synthetic fibers do not lose any appreciable modulus when wetted, and hence webs made with such fibers resist collapse during absorbency tasks. The use of thermally bonded synthetic fibers in tissue products results in a strong network of highly flexible fibers (which is good for softness) joined with water-resistant high-stretch bonds (which is good for softness and wet strength).

Accordingly, the present invention is directed to fibrous structures comprising cellulosic and synthetic fibers in combination, and processes for making such fibrous structures.

SUMMARY OF THE INVENTION

The present invention provides a novel unitary fibrous structure and a process for making such a fibrous structure. The unitary, or single-ply, fibrous structure of the present invention comprises a plurality of cellulosic fibers randomly distributed throughout the fibrous structure, and a plurality of synthetic fibers distributed throughout the fibrous structure in a non-random repeating pattern. The non-random repeating pattern can comprise a substantially continuous network pattern, a substantially semi-continuous pattern, a discrete pattern, and any combination thereof. The fibrous structure can comprise a plurality of micro-regions having a relatively high density and a plurality of micro-regions having a relatively low density. At least one of the pluralities of micro-regions, most typically the plurality of micro-regions having a relatively high density, is registered with the non-random repeating pattern of the plurality of synthetic fibers.

In one embodiment of the fibrous structure, at least a portion of the plurality of synthetic fibers are co-joined with the synthetic fibers and/or with the cellulosic fibers. The fibers can be beneficially co-joined in areas comprising the non-random repeating pattern.

The synthetic fibers can comprise materials selected from the group consisting of polyolefins, polyesters, polyamides, polyhydroxyalkanoates, polysaccharides and any combination thereof. The synthetic fibers can further comprise materials selected from the group consisting of poly(ethylene terephthalate), poly(butylene terephthalate), poly(1,4-cyclohexylenedimethylene terephthalate), isophthalic acid copolymers, ethylene glycol copolymers, polyolefins, poly (lactic acid), poly(hydroxy ether ester), poly(hydroxy ether amide), polycaprolactone, polyesteramide, polysaccharides, and any combination thereof.

A process for making a unitary fibrous structure according to the present invention essentially comprises the steps of (a)

providing a fibrous web comprising a plurality of cellulosic fibers randomly distributed throughout the fibrous web and a plurality of synthetic fibers randomly distributed throughout the fibrous web; and (b) causing redistribution of (redistributing) at least a portion of the synthetic fibers in the web to form the unitary fibrous structure in which a substantial portion of the plurality of synthetic fibers is distributed throughout the fibrous structure in a non-random repeating pattern.

The fibrous web comprising a plurality of cellulosic fibers randomly distributed throughout the web and a plurality of synthetic fibers randomly distributed throughout the web (also termed as "embryonic" web herein) can be prepared by providing an aqueous slurry comprising a plurality of cellulosic fibers mixed with a plurality of synthetic fibers, depositing the aqueous slurry onto a forming member, and partially dewatering the slurry. The process can also include a step of transferring the embryonic fibrous web from the forming member to a molding member on which the embryonic web can be further dewatered and molded according to a desired pattern. The step of redistribution of the synthetic fibers in the fibrous web can take place while the web is disposed on the molding member. Additionally or alternatively, the step of redistribution can take place when the web is in association with a drying surface, such as, for example, a surface of a drying drum.

More specifically, the process for making the fibrous structure can comprise the steps of providing a molding member comprising a plurality of fluid-permeable areas and a plurality of fluid-impermeable areas, disposing the embryonic fibrous web on the molding member in a face-to-face relation therewith, transferring the web to a drying surface, and heating the embryonic web to a temperature sufficient to cause the redistribution of the synthetic fibers in the web. The redistribution of the synthetic fibers can be accomplished by melting of the synthetic fibers, at least partial moving of the synthetic fibers, or a combination thereof.

The molding member is microscopically monoplanar and has a web-contacting side and a backside opposite to the web-contacting side. The fluid-permeable areas, most typically comprising apertures, extend from the web-side to the backside of the molding member. When the fibrous web is disposed on the molding member, the web's fibers tend to conform to the micro-geometry of the molding member so that the fibrous web disposed on the molding member comprises a first plurality of micro-regions corresponding to the plurality of fluid-permeable areas of the molding member and a second plurality of micro-regions corresponding to the plurality of fluid-impermeable areas of the molding member. Fluid pressure differential can be applied to the web disposed on the molding member to facilitate deflection of the first plurality of web's micro-regions into the fluid-permeable areas of the molding member.

The web disposed on the molding member can be heated with a hot gas, either through the molding member or from the opposite side. When the web is heated through the molding member, the first plurality of micro-regions is primarily exposed to the hot gas. The web can also be heated while in association with the drying drum. The web is heated to the temperature that is sufficient to cause redistribution of the synthetic fibers in the fibrous web so that the synthetic fibers comprise a non-random repeating pattern, while the cellulosic fibers remain randomly distributed throughout the web.

One embodiment of the molding member comprises a reinforcing element joined to the patterned framework in a face-to-face relation. In such an embodiment, the patterned framework comprises the web-side of the molding member. The patterned framework can comprise a suitable material selected from the group consisting of resin, metal, glass, plastic, or any other suitable material. The patterned framework can have a substantially continuous pattern, a substantially semi-continuous pattern, a discrete pattern, or any combination thereof.

The process of the present invention can beneficially comprise the step of impressing the embryonic web between the molding member and a suitable pressing surface, such as, for example, a surface of a drying drum, to densify selected portions of the embryonic web. Most typically, the densified portions of the web are those portions that correspond to the plurality of fluid-impermeable areas of the molding member.

In an industrial continuous process exemplified in the figures herein, each of the forming member and the molding member comprises an endless belt continuously travelling around supporting rollers.

DETAILED DESCRIPTION OF THE INVENTION

Figure 1:
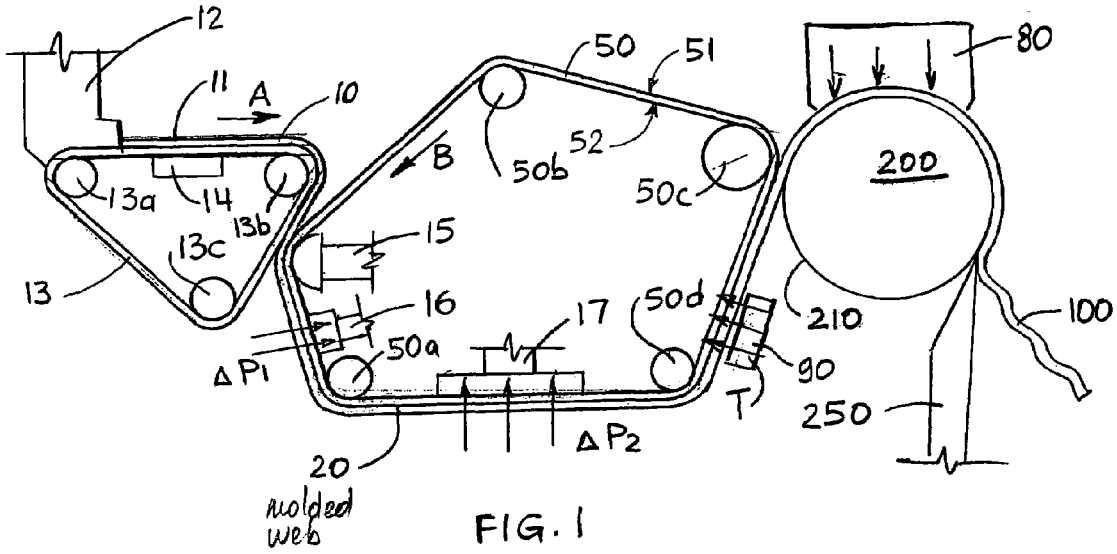
FIG. 1 is a schematic side view of an embodiment of the process of the present invention.

As used herein, the following terms have the following meanings.

"Unitary fibrous structure" is an arrangement comprising a plurality of cellulosic fibers and synthetic fibers that are inter-entangled to form a single-ply sheet product having certain pre-determined microscopic geometric, physical, and aesthetic properties. The cellulosic and/or synthetic fibers may be layered, as known in the art, in the unitary fibrous structure.

"Micro-geometry," or permutations thereof, refers to relatively small (i. e., "microscopical") details of the fibrous structure, such as, for example, surface texture, without regard to the structure's overall configuration, as opposed to its overall (i. e., "macroscopical") geometry. For example, in the molding member of the present invention, the fluid-permeable areas and the fluid-impermeable areas in combination comprises the micro-geometry of the molding member. Terms containing "macroscopical" or "macroscopically" refer to a "macro-geometry," or an overall geometry, of a structure or a portion thereof, under consideration when it is placed in a two-dimensional configuration, such as the X-Y plane. For example, on a macroscopical level, the fibrous structure, when it is disposed on a flat surface, comprises a relatively thin and flat sheet. On a microscopical level, however, the fibrous structure can comprise a plurality of micro-regions that form differential elevations, such as, for example, a network region having a first elevation, and a plurality of fibrous "pillows" dispersed throughout and outwardly extending from the framework region to form a second elevation.

"Basis weight" is the weight (measured in grams) of a unit area (typically measured in square meters) of the fibrous structure, which unit area is taken in the plane of the fibrous structure. The size and shape of the unit area from which the basis weight is measured is dependent upon the relative and absolute sizes and shapes of the regions having differential basis weights.

"Caliper" is a macroscopic thickness of a sample. Caliper should be distinguished from the elevation of differential regions, which is microscopical characteristic of the regions. Most typically, a caliper is measured under a uniformly applied load of 95 grams per square centimeter ($g/cm^2$).

"Density" is the ratio of the basis weight to a thickness (taken normal to the plane of the fibrous structure) of a region. Apparent density is the basis weight of the sample divided by the caliper with appropriate unit conversions incorporated therein. Apparent density used herein has the units of grams per cubic centimeter ($g/cm^3$).

"Machine direction" (or "MD") is the direction parallel to the flow of the fibrous structure being made through the manufacturing equipment. "Cross-machine direction" (or "CD") is the direction perpendicular to the machine direction and parallel to the general plane of the fibrous structure being made.

"X," "Y," and "Z" designate a conventional system of Cartesian coordinates, wherein mutually perpendicular coordinates "X" and "Y" define a reference X-Y plane, and "Z" defines an orthogonal to the X-Y plane. "Z-direction" designates any direction perpendicular to the X-Y plane. Analogously, the term "Z-dimension" means a dimension, distance, or parameter measured parallel to the Z-direction. When an element, such as, for example, a molding member curves or otherwise deplanes, the X-Y plane follows the configuration of the element.

"Substantially continuous" region (area/network/framework) refers to an area within which one can connect any two points by an uninterrupted line running entirely within that area throughout the line's length. That is, the substantially continuous region or pattern has a substantial "continuity" in all directions parallel to the X-Y plane and is terminated only at edges of that region. The term "substantially," in conjunction with "continuous," is intended to indicate that while an absolute continuity is preferred, minor deviations from the absolute continuity may be tolerable as long as those deviations do not appreciably affect the performance of the fibrous structure or a molding member as designed and intended.

"Substantially semi-continuous" region (area/network/framework) refers to an area which has "continuity" in all, but at least one, directions parallel to the X-Y plane, and in which area one cannot connect any two points by an uninterrupted line running entirely within that area throughout the line's length. The semi-continuous framework may have continuity in only one direction parallel to the X-Y plane. By analogy with the continuous region, described above, while an absolute continuity in all, but at least one, directions is preferred, minor deviations from such continuity may be tolerable as long as those deviations do not appreciably affect the performance of the structure or the molding member.

"Discontinuous" regions (or pattern) refer to discrete, and separated from one another areas that are discontinuous in all directions parallel to the X-Y plane.

"Molding member" is a structural element that can be used as a support for an embryonic web comprising a plurality of cellulosic fibers and a plurality of synthetic fibers, as well as a forming unit to form, or "mold," a desired microscopical geometry of the fibrous structure of the present invention. The molding member may comprise any element that has fluid-permeable areas and the ability to impart a microscopical three-dimensional pattern to the structure being produced thereon, and includes, without limitation, single-layer and multi-layer structures comprising a stationary plate, a belt, a woven fabric (including Jacquard-type and the like woven patterns), a band, and a roll.

"Reinforcing element" is a desirable (but not necessary) element in some embodiments of the molding member, serving primarily to provide or facilitate integrity, stability, and durability of the molding member comprising, for example, a resinous material. The reinforcing element can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic, other suitable synthetic material, or any combination thereof.

"Pressing surface" is a surface against which the fibrous web disposed on the web-contacting side of the molding member can be pressed to densify portions of the fibrous web.

"Redistribution temperature" means the temperature or the range of temperature that causes at least a portion of the plurality of synthetic fibers comprising the unitary fibrous structure of the present invention to melt, to at least partially move, to shrink, or otherwise to change their initial position, condition, or shape in the web that results in "redistribution" of a substantial portion of the plurality of synthetic fibers in the fibrous web so that the synthetic fibers comprise a non-random repeating pattern throughout the fibrous web.

"Co-joined fibers" means two or more fibers that have been fused or adhered to one another by melting, gluing, wrapping around, or otherwise joined together, while retaining their respective individual fiber characteristics.

Generally, a process of the present invention for making a unitary fibrous structure 100 comprises the steps of (a) providing a fibrous web 10 comprising a plurality of cellulosic fibers randomly distributed throughout the fibrous web and a plurality of synthetic fibers randomly distributed throughout the fibrous web and (b) causing redistribution of at least a portion of the synthetic fibers in the web to form the unitary fibrous structure 100 in which a substantial portion of the plurality of synthetic fibers is distributed throughout the fibrous structure in a non-random repeating pattern.

The embryonic web 10 can be formed on a forming member 13, as known in the art. In FIG. 1, showing one exemplary embodiment of a continuous process of the present invention, an aqueous mixture, or aqueous slurry, 11, of cellulosic and synthetic fibers, from a headbox 12 can be deposited to a forming member 13 supported by and continuously travelling around rolls 13*a*, 13*b*, and 13*c* in a direction of an arrow A. Depositing the fibers first onto the forming member 13 is believed to facilitate uniformity in the basis weight of the plurality of fibers throughout a width of the fibrous structure 100 being made. Layered deposition of the fibers, synthetic as well as cellulosic, is contemplated by the present invention.

The forming member 13 is fluid-permeable, and a vacuum apparatus 14 located under the forming member 13 and applying fluid pressure differential to the plurality of fibers disposed thereon facilitates at least partial dewatering of the embryonic web 10 being formed on the forming member 13 and encourages a more-or-less even distribution of the fibers throughout the forming member 13. The forming member 13 can comprise any structure known in the art, including, but not limited to, a wire, a composite belt comprising a reinforcing element and a resinous framework joined thereto, and any other suitable structure.

The embryonic web 10, formed on the forming member 13, can be transferred from the forming member 13 to a molding member 50 by any conventional means known in the art, for example, by a vacuum shoe 15 that applies a vacuum pressure which is sufficient to cause the embryonic web 10 disposed on the forming member 13 to separate therefrom and adhere to the molding member 50. In FIG. 1, the molding member 50 comprises an endless belt supported by and traveling around rolls 50*a*, 50*b*, 50*c*, and 50*d* in the direction of an arrow B. The molding member 50 has a web-contacting side 51 and a backside 52 opposite to the web-contacting side.

The fibrous structure of the present invention can be foreshortened. For example, it is contemplated that in the continuous process of the present invention for making the unitary fibrous structure 100, the molding member 50 may have a linear velocity that is less that that of the forming member 13. The use of such a velocity differential at the transfer point from the forming member 13 to the molding member 50 is commonly known in the papermaking art and can be used to achieve so called "microcontraction" that is typically believed to be efficient when applied to low-consistency, wet webs. U. S. Pat. No. 4,440,597, the disclosure of which is incorporated herein by reference for the purpose of describing principal mechanism of microcontraction, describes in detail such "wet-microcontraction." Briefly, the wet-microcontraction involves transferring the web having a low fiber-consistency from a first member (such as a foraminous forming member) to a second member (such as an open-weave fabric) moving slower than the first member. The velocity of the forming member 13 can be from about 1% to about 25% greater than that of the molding member 50. Other patents that describe a so-called rush-transfer that causes micro-contraction include, for example, U.S. Pat. Nos. 5,830,321; 6,361,654; and 6,171,442, the disclosures of which are incorporated herein by reference for the purpose of describing the rush transfer processes and products made thereby.

In some embodiments, the plurality of cellulosic fibers and the plurality of synthetic fibers can be deposited directly onto the web-contacting side 51 of the molding member 50. The backside 52 of the molding member 50 typically contacts the equipment, such as support rolls, guiding rolls, a vacuum apparatus, etc., as required by a specific process. The molding member 50 comprises a plurality of fluid-permeable areas 54 and a plurality of fluid-impermeable areas 55, FIGS. 2 and 3. The fluid-permeable areas 54 extend through a thickness H of the molding member 50, from the web-side 51 to the backside 52 of the molding member 50, FIG. 3. Beneficially, at least one of the plurality of fluid-permeable areas 54 and the plurality of fluid-impermeable areas 55 forms a non-random repeating pattern throughout the molding member 50. Such a pattern can comprise a substantially continuous pattern (FIG. 2), a substantially semi-continuous pattern (FIG. 4), a discrete pattern (FIG. 5) or any combination thereof. The fluid-permeable areas 54 of the molding member 50 can comprise apertures extending from the web-contacting side 51 to the backside 52 of the molding member 50. The walls of the apertures can be perpendicular relative to the web-contacting surface 51, or, alternatively, can be inclined as shown in FIGS. 2, 3, 5, and 6. If desired, several fluid-permeable areas 54 comprising apertures may be "blind," or "closed" (not shown), as described in U.S. Pat. No. 5,972,813, issued to Polat et al. on Oct. 26, 1999, the disclosure of which is incorporated herein by reference.

Figure 7:
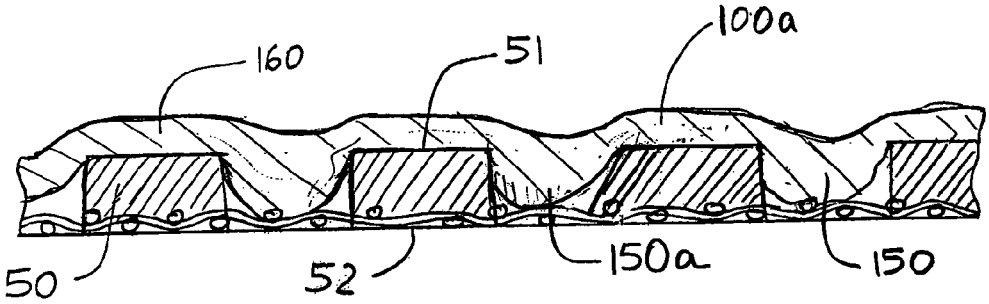
FIG. 7 is a schematic cross-sectional view of the unitary fibrous structure of the present invention disposed on the molding member.

When the embryonic web 10 comprising a plurality of randomly distributed cellulosic fibers and a plurality of randomly distributed synthetic fibers is deposited onto the web-contacting side 51 of the molding member 50, the embryonic web 10 disposed on the molding member 50 at least partially conforms to the pattern of the molding member 50, FIG. 7. For reader's convenience, the fibrous web disposed on the molding member 50 is designated by a reference numeral 20 (and may be termed as "molded" web).

The molding member 50 can comprise a belt or band that is macroscopically monoplanar when it lies in a reference X-Y plane, wherein a Z-direction is perpendicular to the X-Y plane. Likewise, the unitary fibrous structure 100 can be thought of as macroscopically monoplanar and lying in a plane parallel to the X-Y plane. Perpendicular to the X-Y plane is the Z-direction along which extends a caliper, or thickness H, of the structure 100, or elevations of the differential micro-regions of the molding member 50 or of the structure 100.

If desired, the molding member 50 comprising a belt may be executed as a press felt (not shown). A suitable press felt for use according to the present invention may be made according to the teachings of U.S. Pat. No. 5,549,790, issued Aug. 27, 1996 to Phan; U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al.; U.S. Pat. No. 5,776,307 issued Jul. 7, 1998 to Ampulski et al.; U.S. Pat. No. 5,795,440 issued Aug. 18, 1998 to Ampulski et al.; U.S. Pat. No. 5,814,190 issued Sep. 29, 1998 to Phan; U.S. Pat. No. 5,817,377 issued Oct. 6, 1998 to Trokhan et al.; U.S. Pat. No. 5,846,379 issued Dec. 8, 1998 to Ampulski et al.; U.S. Pat. No. 5,855,739 issued Jan. 5, 1999 to Ampulski et al.; and U.S. Pat. No. 5,861,082 issued Jan. 19, 1999 to Ampulski et al., the disclosures of which are incorporated herein by reference. In an alternative embodiment, the molding member 200 may be executed as a press felt according to the teachings of U.S. Pat. No. 5,569,358 issued Oct. 29, 1996 to Cameron.

Figure 2:
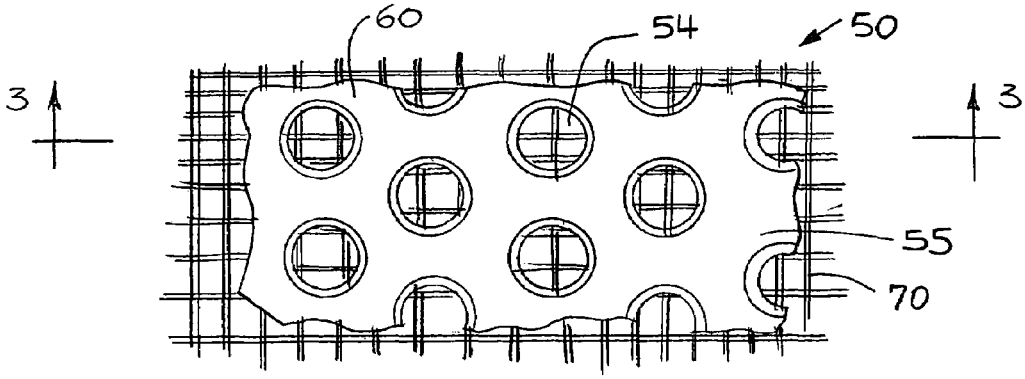
FIG. 2 is a schematic plan view of an embodiment of the molding member having a substantially continuous framework.
Figure 3:
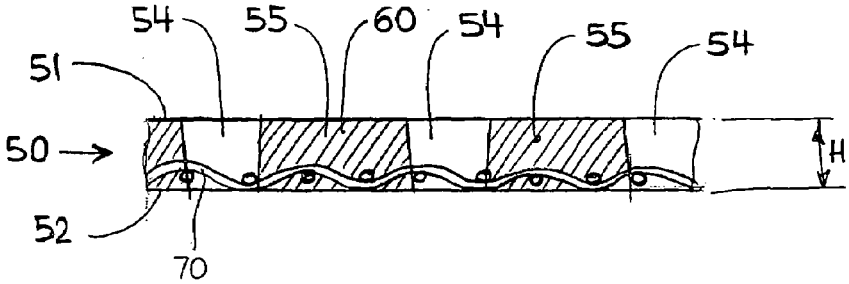
FIG. 3 is a schematic cross-sectional view of the molding member shown in and taken along the lines 3—3 in FIG. 2.
Figure 4:
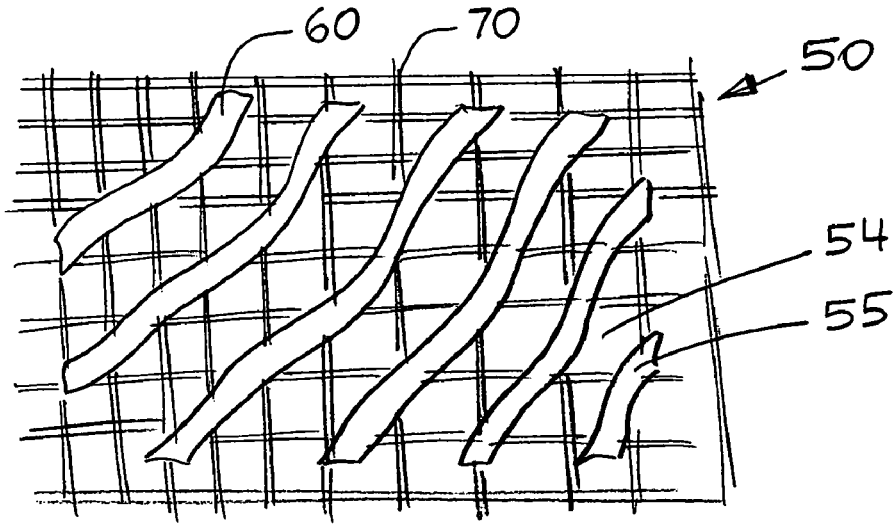
FIG. 4 is a schematic plan view of an embodiment of the molding member having a substantially semi-continuous framework.
Figure 5:
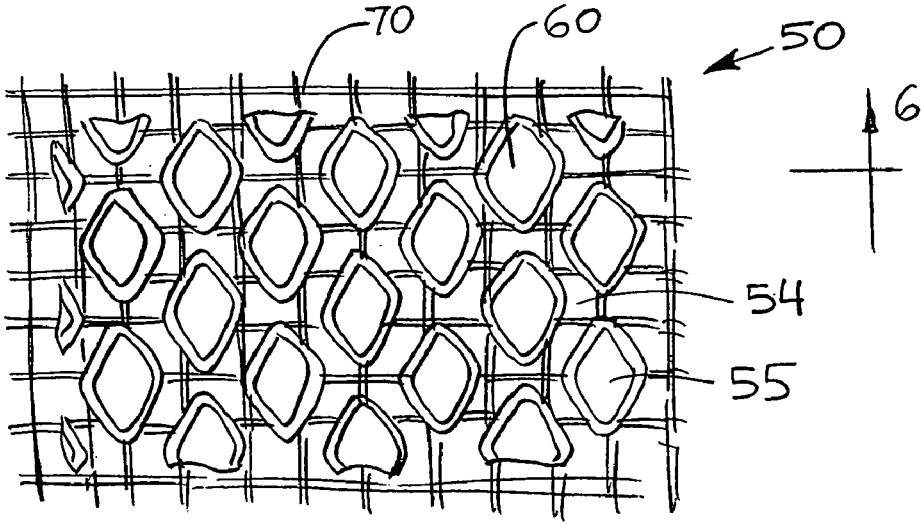
FIG. 5 is a schematic plan view of an embodiment of the molding member having a discrete pattern framework.
Figure 6:
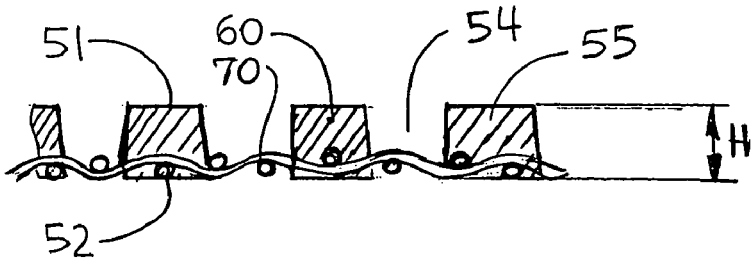
FIG. 6 is a schematic cross-sectional view taken along line 6—6 of FIG. 5.

One principal embodiment of the molding member 50 comprises a resinous framework 60 joined to a reinforcing element 70, FIGS. 2–6. The resinous framework 60 can have a certain pre-selected pattern, that can be substantially continuous (FIG. 2), substantially semi-continuous (FIG. 4), discrete (FIGS. 5 and 6) or any combination of the above. For example, FIGS. 2 and 3 show a substantially continuous framework 60 having a plurality of apertures therethrough. The reinforcing element 70 can be substantially fluid-permeable and may comprise a woven screen as shown in FIGS. 2–6, or a non-woven element such as an apertured element, a felt, a net, a plate having a plurality of holes, or any combination thereof. The portions of the reinforcing element 70 registered with apertures 54 in the molding member 50 provide support for the fibers deflected into the fluid-permeable areas of the molding member during the process of making the unitary fibrous structure 100 and prevent fibers of the web being made from passing through the molding member 50 (FIG. 7), thereby reducing occurrences of pinholes in the resulting structure 100. Suitable reinforcing element 70 may be made according to U.S. Pat. No. 5,496,624, issued Mar. 5, 1996 to Stelljes, et al., U.S. Pat. No. 5,500,277 issued Mar. 19, 1996 to Trokhan et al., and U.S. Pat. No. 5,566,724 issued Oct. 22, 1996 to Trokhan et al., the disclosures of which are incorporated herein by reference.

The framework 60 may be applied to the reinforcing element 70, as taught by U.S. Pat. No. 5,549,790, issued Aug. 27, 1996 to Phan; U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al., U.S. Pat. No. 5,795,440 issued Aug. 18, 1998 to Ampulski et al., U.S. Pat. No. 5,814,190 issued Sep. 29, 1998 to Phan; U.S. Pat. No. 5,817,377 issued Oct. 6, 1998 to Trokhan et al.; and U.S. Pat. No. 5,846,379 issued Dec. 8, 1998 to Ampulski et al., the disclosures of which are incorporated herein by reference.

If desired, the reinforcing element 70 comprising a Jacquard-type weave, or the like, can be utilized. Illustrative belts can be found in U.S. Pat. No. 5,429,686 issued Jul. 4, 1995 to Chiu, et al.; U.S. Pat. No. 5,672,248 issued Sep. 30, 1997 to Wendt, et al.; U.S. Pat. No. 5,746,887 issued May 5, 1998 to Wendt, et al.; and U.S. Pat. No. 6,017,417 issued Jan. 25, 2000 to Wendt, et al., the disclosures of which are incorporated herein by reference for the limited purpose of showing a principal construction of the pattern of the weave. The present invention contemplates the molding member 50 comprising the web-contacting side 51 having such a Jacquard-weave or the like pattern. Various designs of the Jacquard-weave pattern may be utilized as a forming member 13, a molding member 50, and a pressing surface 210. A Jacquard weave is reported in the literature to be particularly useful where one does not wish to compress or imprint a structure in a nip, such as typically occurs upon transfer to a drying drum, such as, for example, a Yankee drying drum.

The molding member 50 can comprise a plurality of suspended portions extending (typically laterally) from a plurality of base portions, as is taught by a commonly assigned patent application Ser. No. 09/694,915, filed on Oct. 24, 2000 in the names of Trokhan et al., which issued as U.S. Pat. No. 6,576,090, the disclosure of which is incorporated by reference herein. The suspended portions are elevated from the reinforcing element 70 to form void spaces between the suspended portions and the reinforcing element, into which spaces the fibers of the embryonic web 10 can be deflected to form cantilever portions of the fibrous structure 100. The molding member 50 having suspended portions may comprise a multi-layer structure formed by at least two layers and joined together in a face-to-face relationship. Each of the layers can comprise a structure similar to those shown in figures herein. The joined layers are positioned such that the apertures of one layer are superimposed (in the direction perpendicular to the general plane of the molding member 50) with a portion of the framework of the other layer, which portion forms the suspended portion described above. Another embodiment of the molding member 50 comprising a plurality of suspended portions can be made by a process involving differential curing of a layer of a photosensitive resin, or other curable material, through a mask comprising transparent regions and opaque regions. The opaque regions comprise regions having differential opacity, for example, regions having a relatively high opacity (non-transparent, such as black) and regions having a relatively low, partial, opacity (i.e. having some transparency).

As soon as the embryonic web 10 is disposed on the web-contacting side 51 of the molding member 50, the web 10 at least partially conforms to the three-dimensional pattern of the molding member 50, FIG. 7. In addition, various means can be utilized to cause or encourage the cellulosic and synthetic fibers of the embryonic web 10 to conform to the three-dimensional pattern of the molding member 50 and to become a molded web (designated as "20" in FIG. 1 for reader's convenience. It is to be understood, however, that the referral numerals "10" and "20" can be used herein interchangeably, as well as the terms "embryonic web" and "molded web").

One method comprises applying a fluid pressure differential to the plurality of fibers. For example, vacuum apparatuses 16 and/or 17 disposed at the backside 52 of the molding member 50 can be arranged to apply a vacuum pressure to the molding member 50 and thus to the plurality of fibers disposed thereon, FIG. 1. Under the influence of fluid pressure differential $\Delta P1$ and/or $\Delta P2$ created by the vacuum pressure of the vacuum apparatuses 16 and 17, respectively, portions of the embryonic web 10 can be deflected into the apertures of the molding member 50 and otherwise conform to the three-dimensional pattern thereof.

Figure 11:
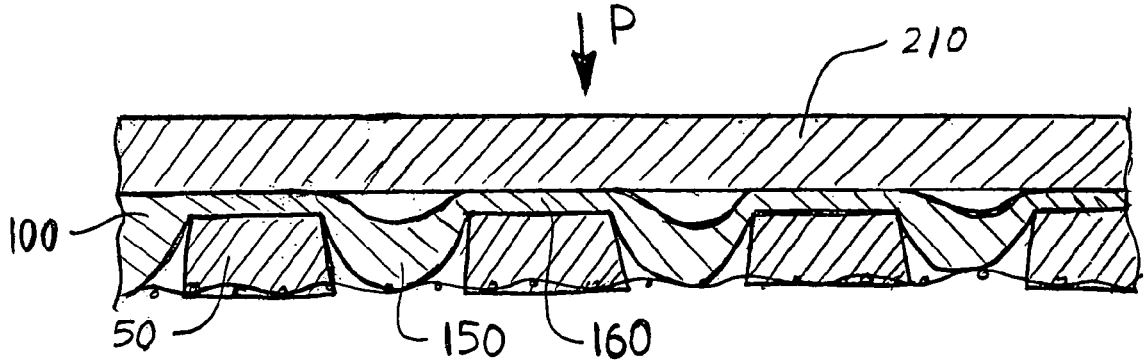
FIG. 11 is a schematic cross-sectional view of the unitary fibrous structure of the present invention impressed between a pressing surface and the molding member.

By deflecting portions of the web into the apertures of the molding member 50, one can decrease the density of resulting pillows 150 formed in the apertures of the molding member 50, relative to the density of the rest of the molded web 20. Regions 160 that are not deflected in the apertures may later be imprinted by impressing the web 20 between a pressing surface 210 and the molding member 50 (FIG. 11), such as in a compression nip formed between a surface 210 of a drying drum 200 and the roll 50*c*, FIG. 1. If imprinted, the density of the regions 160 increases even more relative to the density of the pillows 150.

The two pluralities of micro-regions of the fibrous structure 100 may be thought of as being disposed at two different elevations. As used herein, the elevation of a region refers to its distance from a reference plane (i. e., X-Y plane). For convenience, the reference plane can be visualized as horizontal, wherein the elevational distance from the reference plane is vertical (i.e., Z-directional). The elevation of a particular micro-region of the structure 100 may be measured using any non-contacting measurement device suitable for such purpose as is well known in the art. A particularly suitable measuring device is a non-contacting Laser Displacement Sensor having a beam size of 0.3×1.2 millimeters at a range of 50 millimeters. Suitable non-contacting Laser Displacement Sensors are sold by the Idec Company as models MX1A/B. Alternatively, a contacting stylis gauge, as is known in the art, may be utilized to measure the different elevations. Such a stylis gauge is described in U.S. Pat. No. 4,300,981 issued to Carstens, the disclosure of which is incorporated herein by reference. The fibrous structure 100 according to the present invention can be placed on the reference plane with the imprinted region 160 in contact with the reference plane. The pillows 150 extend vertically away from the reference plane. The plurality of pillows 150 may comprise symmetrical pillows, asymmetrical pillows (numerical reference 150*a* in FIG. 7), or a combination thereof.

Differential elevations of the micro-regions can also be formed by using the molding member 50 having differential depths or elevations of its three-dimensional pattern (not shown). Such three-dimensional patterns having differential depths/elevations can be made by sanding pre-selected portions of the molding member 50 to reduce their elevation. Also, the molding member 50 comprising a curable material can be made by using a three-dimensional mask. By using a three-dimensional mask comprising differential depths/elevations of its depressions/protrusions, one can form a corresponding framework 60 also having differential elevations. Other conventional techniques of forming surfaces with differential elevation can be used for the foregoing purposes.

To ameliorate possible negative effects of a sudden application of a fluid pressure differential to the fibrous structure being made, by a vacuum apparatuses 16 and/or 17 and/or a vacuum pick-up shoe 15 (FIG. 1), that could force some of the filaments or portions thereof all the way through the molding member 200 and thus lead to forming so-called pin-holes in the resultant fibrous structure, the backside 52 of the molding member 50 can be "textured" to form microscopical surface irregularities. Those surface irregularities can be beneficial in some embodiments of the molding member 50, because they prevent formation of a vacuum seal between the backside 52 of the molding member 50 and a surface of the papermaking equipment (such as, for example, a surface of the vacuum apparatus), thereby creating a "leakage" therebetween and thus mitigating undesirable consequences of an application of a vacuum pressure in a through-air-drying process. Other methods of creating such a leakage are disclosed in U.S. Pat. Nos. 5,718,806; 5,741,402; 5,744,007; 5,776,311; and 5,885,421, the disclosures of which are incorporated herein by reference.

The leakage can also be created using so-called "differential light transmission techniques" as described in U.S. Pat. Nos. 5,624,790; 5,554,467; 5,529,664; 5,514,523; and 5,334,289, the disclosures of which are incorporated herein by reference. The molding member can be made by applying a coating of photosensitive resin to a reinforcing element that has opaque portions, and then exposing the coating to light of an activating wavelength through a mask having transparent and opaque regions, and also through the reinforcing element.

Another way of creating backside surface irregularities comprises the use of a textured forming surface, or a textured barrier film, as described in U.S. Pat. Nos. 5,364,504; 5,260,171; and 5,098,522, the disclosures of which are incorporated herein by reference. The molding member can be made by casting a photosensitive resin over and through the reinforcing element while the reinforcing element travels over a textured surface, and then exposing the coating to light of an activating wavelength through a mask, which has transparent and opaque regions.

The process may include an optional step wherein the embryonic web 10 (or molded web 20) is overlaid with a flexible sheet of material comprising an endless band traveling along with the molding member so that the embryonic web 10 is sandwiched, for a certain period of time, between the molding member and the flexible sheet of material (not shown). The flexible sheet of material can have air-permeability less than that of the molding member, and in some embodiments can be air-impermeable. An application of a fluid pressure differential to the flexible sheet through the molding member 50 causes deflection of at least a portion of the flexible sheet towards, and in some instances into, the three-dimensional pattern of the molding member 50, thereby forcing portions of the web disposed on the molding member 50 to closely conform to the three-dimensional pattern of the molding member 50. U.S. Pat. No. 5,893,965, the disclosure of which is incorporated herein by reference, describes a principle arrangement of a process and equipment utilizing the flexible sheet of material.

Additionally or alternatively to the fluid pressure differential, mechanical pressure can also be used to facilitate formation of the microscopical three-dimensional pattern of the fibrous structure 100 of the present invention. Such a mechanical pressure can be created by any suitable press surface, comprising, for example a surface of a roll or a surface of a band (not shown). The press surface can be smooth or have a three-dimensional pattern of its own. In the latter instance, the press surface can be used as an embossing device, to form a distinctive micro-pattern of protrusions and/or depressions in the fibrous structure 100 being made, in cooperation with or independently from the three-dimensional pattern of the molding member 50. Furthermore, the press surface can be used to deposit a variety of additives, such for example, as softeners, and ink, to the fibrous structure being made. Various conventional techniques, such as, for example, ink roll, or spraying device, or shower (not shown), may be used to directly or indirectly deposit a variety of additives to the fibrous structure being made.

Figure 8:
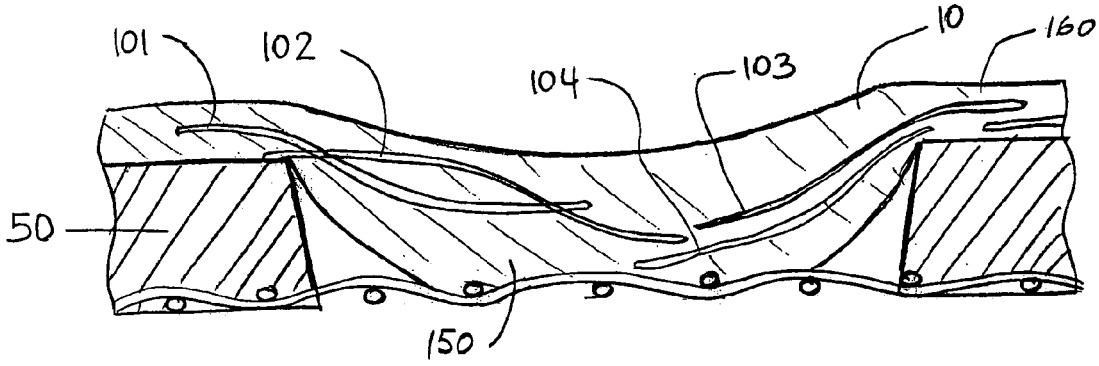
FIG. 8 is a more detailed schematic cross-sectional view of an embryonic web disposed on the molding member, showing exemplary synthetic fibers randomly distributed throughout the fibrous structure.
Figure 9:
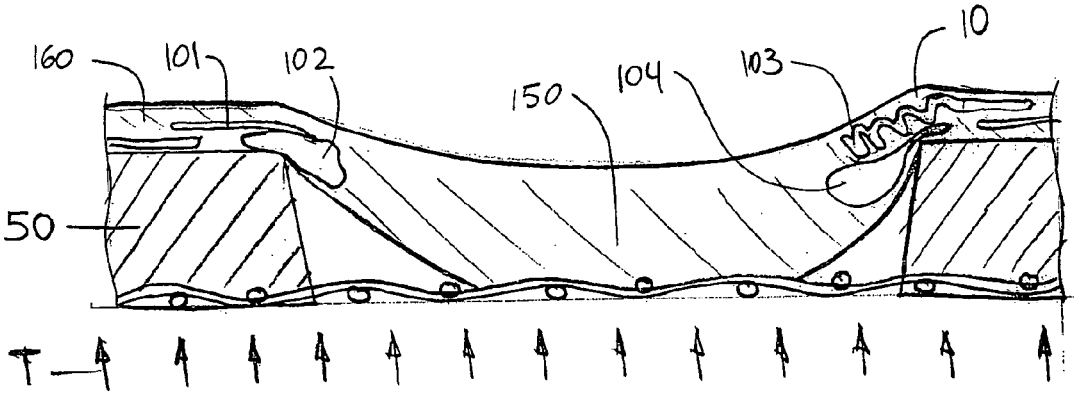
FIG. 9 is a cross-sectional view similar to that of FIG. 8, showing the unitary fibrous structure of the present invention, wherein the synthetic fibers are distributed throughout the structure in a non-random repeating pattern.

The step of redistribution of at least a portion of the synthetic fibers in the web may be accomplished after the web-forming step. Most typically, the redistribution can occur while the web is disposed on the molding member 50, for example by a heating apparatus 90, and/or the drying surface 210, for example by a heating apparatus 80, shown in FIG. 1 in association with a drying drum's hood (such as, for example, a Yankee's drying hood). In both instances, arrows schematically indicate a direction of the hot gas impinging upon the fibrous web. The redistribution may be accomplished by causing at least a portion of the synthetic fibers to melt or otherwise change their configuration. Without wishing to be bound by theory, we believe that at a redistribution temperature ranging from about 230° C. to about 300° C., at least portions of the synthetic fibers comprising the web can move as a result as their shrinking and/or at least partial melting under the influence of high temperature. FIGS. 8 and 9 are intended to schematically illustrate the redistribution of the synthetic fibers in the embryonic web 10. In FIG. 8, exemplary synthetic fibers 101, 102, 103, and 104 are shown randomly distributed throughout the web, before the heat has been applied to the web. In FIG. 9, the heat T is applied to the web, causing the synthetic fibers 101-104 to at least partially melt, shrink, or otherwise change their shape thereby causing redistribution of the synthetic fibers in the web.

Without wishing to be bound by theory, we believed that the synthetic fibers can move after application of a sufficiently high temperature, under the influence of at least one of two phenomena. If the temperature is sufficiently high to melt the synthetic (polymeric) fiber, the resulting liquid polymer will tend to minimize its surface area/mass, due to surface tension forces, and form a sphere-like shape (102, 104 in FIG. 9) at the end of the portion of fiber that is less affected thermally. On the other hand, if the temperature is below the melting point, fibers with high residual stresses will soften to the point where the stress is relieved by shrinking or coiling of the fiber. This is believed to occur because polymer molecules typically prefer to be in a non-linear coiled state. Fibers that have been highly drawn and then cooled during their manufacture are comprised of polymer molecules that have been stretched into a metastable configuration. Upon subsequent heating the molecules, and hence the fiber, returns to the minimum free energy coiled state.

Figure 12:
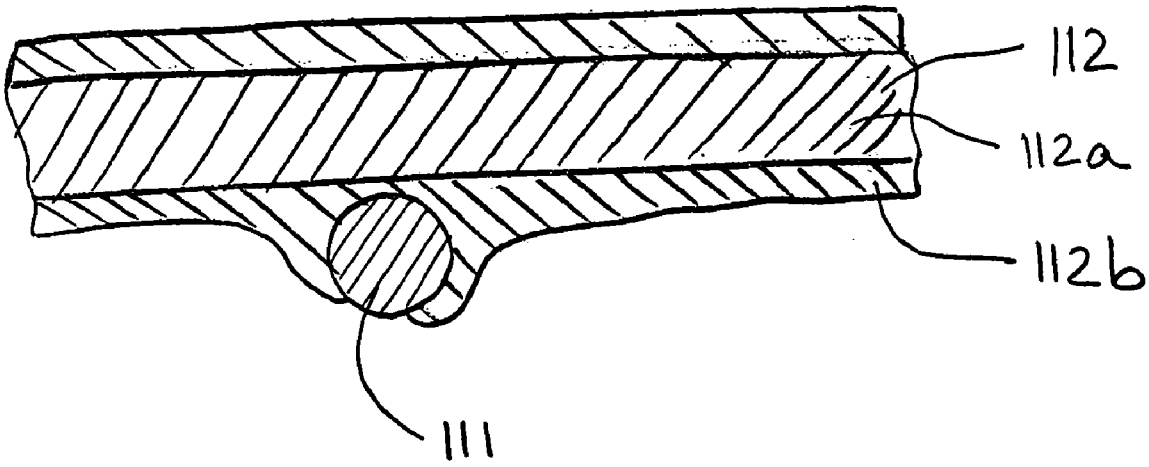
FIG. 12 is a schematic cross-sectional view of a bi-component synthetic fiber co-joined with another fiber.

As the synthetic fibers at least partially melt or soft, they become capable of co-joining with adjacent fibers, whether cellulosic fibers or other synthetic fibers. Without wishing to be limited by theory, we believe that co-joining of fibers can comprise mechanical co-joining and chemical co-joining. Chemical co-joining occurs when at least two adjacent fibers join together on a molecular level such that the identity of the individual co-joined fibers is substantially lost in the co-joined area. Mechanical co-joining of fibers takes place when one fiber merely conforms to the shape of the adjacent fiber, and there is no chemical reaction between the co-joined fibers. FIG. 12 schematically shows one embodiment of the mechanical co-joining, wherein a fiber 111 is physically "entrapped" by an adjacent synthetic fiber 112. The fiber 111 can be a synthetic fiber or a cellulosic fiber. In an example shown in FIG. 12, the synthetic fiber 112 comprises a bi-component structure, comprising a core 112*a* and a sheath, or shell, 112*b*, wherein the melting temperature of the core 112*a* is greater than the melting temperature of the sheath 112*b*, so that when heated, only the sheath 112*b* melts, while the core 112*a* retains its integrity. It is to be understood that multi-component fibers comprising more than two components can be used in the present invention.

Heating the synthetic fibers in the web can be accomplished by heating the plurality of micro-regions corresponding to the fluid-permeable areas of the molding member 50. For example, a hot gas from the heating apparatus 90 can be forced through the web, as schematically shown in FIG. 1. Pre-dryers (not shown) can also be used as the source of energy to do the redistribution of the fibers. It is to be understood that depending on the process, the direction of the flow of hot gas can be reversed relative to that shown in FIG. 1, so that the hot gas penetrates the web through the molding member, FIG. 9. Then, "pillow" portions 150 of the web that are disposed in the fluid-permeable areas of the molding member 50 will be primarily affected by the hot temperature gas. The rest of the web will be shielded from the hot gas by the molding member 50. Consequently, the co-joined fibers will be co-joined predominantly in the pillow portions 150 of the web. Depending on the process, the synthetic fibers can be redistributed such that the plurality of micro-regions having a relatively high density is registered with the non-random repeating pattern of the plurality of synthetic fibers. Alternatively, the synthetic fibers can be redistributed such that the plurality of micro-regions having a relatively low density is registered with the non-random repeating pattern of the plurality of synthetic fibers.

Figure 10:
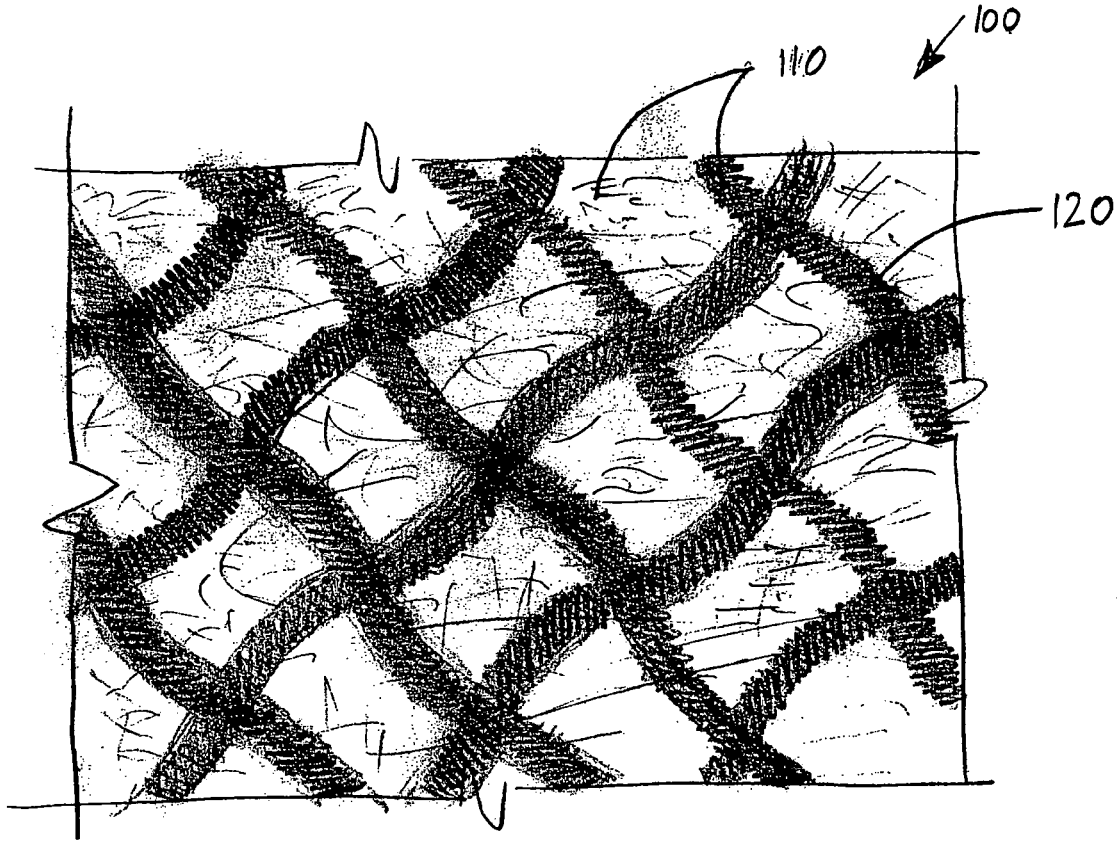
FIG. 10 is a schematic plan view of an embodiment of the unitary fibrous structure of the present invention.

While the synthetic fibers get redistributed in a manner described herein, the random distribution of the cellulosic fibers is not affected by the heat. Thus, the resulting fibrous structure 100 comprises a plurality of cellulosic fibers randomly distributed throughout the fibrous structure and a plurality of synthetic fibers distributed throughout the fibrous structure in a non-random repeating pattern. FIG. 10 schematically shows one embodiment of the fibrous structure 100 wherein the cellulosic fibers 110 are randomly distributed throughout the structure, and the synthetic fibers 120 are redistributed in a non-random repeating pattern.

The fibrous structure 100 may have a plurality of micro-regions having a relatively high basis weight and a plurality of regions having a relatively low basis weight. The non-random repeating pattern of the plurality of synthetic fibers may be registered with the micro-regions having a relatively high basis weight. Alternatively, the non-random repeating pattern of the plurality of synthetic fibers may be registered with the micro-regions having a relatively low basis weight. The non-random repeating pattern of the synthetic fibers may be selected from the group consisting of a substantially continuous pattern, a substantially semi-continuous pattern, a discrete pattern, or any combination thereof, as defined herein.

The material of the synthetic fibers can be selected from the group consisting of polyolefines, polyesters, polyamides, polyhydroxyalkanoates, polysaccharides, and any combination thereof. More specifically, the material of the synthetic fibers can be selected from the group consisting of poly (ethylene terephthalate), poly(butylene terephthalate), poly (1,4-cyclohexylenedimethylene terephthalate), isophthalic acid copolymers, ethylene glycol copolymers, polyolefins, poly(lactic acid), poly(hydroxy ether ester), poly(hydroxy ether amide), polycaprolactone, polyesteramide, polysaccharides, and any combination thereof.

If desired, the embryonic or molded web may have differential basis weight. One way of creating differential basis weight micro-regions in the fibrous structure 100 comprises forming the embryonic web 10 on the forming member comprising a structure principally shown in FIGS. 5 and 6, i. e., the structure comprising a plurality of discrete protuberances joined to a fluid-permeable reinforcing element, as described in commonly assigned U.S. Pat. Nos. 5,245,025; 5,277,761; 5,443,691; 5,503,715; 5,527,428; 5,534,326; 5,614,061; and 5,654,076, the disclosures of which are incorporated herein by reference. The embryonic web 10 formed on such a forming member will have a plurality of micro-regions having a relatively high basis weight, and a plurality of micro-regions having a relatively low basis weight.

In another embodiment of the process, the step of redistribution may be accomplished in two steps. As an example, first, the synthetic fibers can be redistributed while the fibrous web is disposed on the molding member, for example, by blowing hot gas through the pillows of the web, so that the synthetic fibers are redistributed according to a first pattern, such, for example, that the plurality of micro-regions having a relatively low density is registered with the non-random repeating pattern of the plurality of synthetic fibers. Then, the web can be transferred to another molding member wherein the synthetic fibers can be further redistributed according to a second pattern.

The fibrous structure 100 may optionally be foreshortened, as is known in the art. Foreshortening can be accomplished by creping the structure 100 from a rigid surface, such as, for example, a surface 210 of a drying drum 200, FIG. 1. Creping can be accomplished with a doctor blade 250, as is also well known in the art. For example, creping may be accomplished according to U.S. Pat. No. 4,919,756, issued Apr. 24, 1992 to Sawdai, the disclosure of which is incorporated herein by reference. Alternatively or additionally, foreshortening may be accomplished via microcontraction, as described above.

The fibrous structure 100 that is foreshortened is typically more extensible in the machine direction than in the cross machine direction and is readily bendable about hinge lines formed by the foreshortening process, which hinge lines extend generally in the cross-machine direction, i. e., along the width of the fibrous structure 100. The fibrous structure 100 that is not creped and/or otherwise foreshortened, is contemplated to be within the scope of the present invention.

A variety of products can be made using the fibrous structure 100 of the present invention. The resultant products may find use in filters for air, oil and water; vacuum cleaner filters; furnace filters; face masks; coffee filters, tea or coffee bags; thermal insulation materials and sound insulation materials; nonwovens for one-time use sanitary products such as diapers, feminine pads, and incontinence articles; biodegradable textile fabrics for improved moisture absorption and softness of wear such as microfiber or breathable fabrics; an electrostatically charged, structured web for collecting and removing dust; reinforcements and webs for hard grades of paper, such as wrapping paper, writing paper, newsprint, corrugated paper board, and webs for tissue grades of paper such as toilet paper, paper towel, napkins and facial tissue; medical uses such as surgical drapes, wound dressing, bandages, and dermal patches. The fibrous structure may also include odor absorbants, termite repellents, insecticides, rodenticides, and the like, for specific uses. The resultant product absorbs water and oil and may find use in oil or water spill clean-up, or controlled water retention and release for agricultural or horticultural applications.

The invention claimed is:

1. A process for making a unitary fibrous structure, comprising steps of:

providing an embryonic fibrous web comprising a plurality of cellulosic fibers randomly distributed throughout the fibrous web and a plurality of synthetic fibers randomly distributed throughout the fibrous web;

redistributing at least a portion of the synthetic fibers in the web such that the web comprises two or more regions of different basis weight of the synthetic fibers; and densifying the web such that a plurality of micro-regions having a relatively high density and a plurality of micro-regions having a relatively low density are formed and wherein at least one of the regions of relatively high density is registered with a region of relatively high basis weight of synthetic fibers.

2. The process of claim 1, wherein the step of redistributing at least a portion of the synthetic fibers comprises melting of the synthetic fibers.

3. The process of claim 1, wherein the step of redistributing at least a portion of the synthetic fibers comprises causing at least partial moving of the synthetic fibers.

4. The process of claim 2, wherein the step of redistributing at least a portion of the synthetic fibers comprises causing at least partial moving of the synthetic fibers.

5. The process of claim 1, further comprising steps of:

providing a microscopically monoplanar molding member comprising a plurality of fluid-permeable areas and a plurality of fluid-impermeable areas;

providing a drying surface structured to receive the fibrous web thereon;

disposing the fibrous web on the molding member in a face-to-face relation therewith;

transferring the fibrous web to the drying surface; and heating the web with hot gas to a temperature sufficient to cause redistribution of at least a portion of the synthetic fibers in the fibrous web.

6. The process of claim 5, further comprising the step of impressing the embryonic web between the molding member and a pressing surface to densify portions of the embryonic web.

7. The process of claim 5, wherein the step of providing a molding member comprises providing a molding member comprising a patterned framework selected from the group consisting of a substantially continuous pattern, a substantially semi-continuous pattern, a discrete pattern, or any combination thereof.

8. The process of claim 1, wherein the step of providing an embryonic fibrous web comprises steps of:

providing an aqueous slurry comprising a plurality of cellulosic fibers mixed with a plurality of synthetic fibers;

depositing the aqueous slurry onto a forming member; and partially dewatering the slurry to form the embryonic fibrous web comprising a plurality of cellulosic fibers randomly distributed throughout the web and a plurality of synthetic fibers randomly distributed throughout the web.

9. A process for making a unitary fibrous structure, comprising steps of:

providing an aqueous slurry comprising a plurality of cellulosic fibers mixed with a plurality of synthetic fibers;

depositing the aqueous slurry onto a macroscopically monoplanar fluid-permeable forming member and partially dewatering the deposited slurry to form a fibrous web comprising a plurality of cellulosic fibers randomly distributed throughout the fibrous web and a plurality of synthetic fibers randomly distributed throughout the fibrous web;

transferring the fibrous web from the forming member to a microscopically monoplanar molding member comprising a non-random repeating pattern of a plurality of fluid-permeable areas and a plurality of fluid-impermeable areas;

applying a fluid pressure differential to the fibrous web disposed on the molding member, thereby molding the fibrous web according to the non-random repeating pattern, wherein the fibrous web disposed on the molding member comprises a first plurality of micro-regions corresponding to the plurality of fluid-permeable areas of the molding member and a second plurality of micro-regions corresponding to the plurality of fluid-impermeable areas of the molding member;

transferring the fibrous web from the molding member to a drying surface;

heating the fibrous web to a temperature sufficient to cause redistribution of at least a portion of the synthetic fibers in the fibrous web, thereby forming the unitary fibrous structure in which a substantial portion of the plurality of synthetic fibers is re-distributed throughout the fibrous structure such that the web comprises two or more regions of different basis weight of the synthetic fibers, while the plurality of cellulosic fibers remains randomly distributed throughout the fibrous structure; and densifying the web such that a plurality of micro-regions having a relatively high density and a plurality of micro-regions having a relatively low density are formed and wherein at least one of the regions of relatively high density is registered with a region of relatively high basis weight of synthetic fibers.

10. The process of claim 9, wherein the step of heating the fibrous web occurs when the fibrous web is disposed on at least one of the molding member and the drying surface.

* * * * *